US009321622B2

(12) United States Patent
Connerat et al.

(10) Patent No.: US 9,321,622 B2
(45) Date of Patent: Apr. 26, 2016

(54) BEVERAGE DISPENSER CONTAINER AND CARTON

(71) Applicant: The Coca-Cola Company, Atlanta, GA (US)

(72) Inventors: Bryan Connerat, Atlanta, GA (US); Mark Friedlein, Peachtree City, GA (US); Carlos J. Ayala-Diaz, Dacula, GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 14/209,596

(22) Filed: Mar. 13, 2014

(65) Prior Publication Data

US 2014/0263442 A1 Sep. 18, 2014

Related U.S. Application Data

(60) Provisional application No. 61/792,959, filed on Mar. 15, 2013.

(51) Int. Cl.

| | |
|---|---|
| ***B67D 1/00*** | (2006.01) |
| ***B67D 7/06*** | (2010.01) |
| ***B67D 7/84*** | (2010.01) |
| ***B65D 5/72*** | (2006.01) |
| ***B67D 3/00*** | (2006.01) |
| ***B65D 77/06*** | (2006.01) |

(52) U.S. Cl.

CPC ..... *B67D 1/0004* (2013.01); *B65D 5/726* (2013.01); *B65D 77/065* (2013.01); *B67D 1/0078* (2013.01); *B67D 3/0029* (2013.01); *B67D 3/0067* (2013.01); *B67D 7/06* (2013.01); *B67D 7/84* (2013.01); *Y10T 29/49826* (2015.01)

(58) Field of Classification Search

USPC ..... 222/105, 181.1, 183, 129.1, 131, 325, 222/465.1, 129.4, 185.1, 184; 220/669; 206/459.5

See application file for complete search history.

(56) References Cited

U.S. PATENT DOCUMENTS

| | | | | |
|---|---|---|---|---|
| 3,233,817 | A | 2/1966 | Casady | |
| 3,908,864 | A | 9/1975 | Capper | |
| 6,412,663 | B1 * | 7/2002 | Adamson, II | A47G 23/0258 220/737 |
| 6,871,679 | B2 | 3/2005 | Last | |
| 8,201,712 | B2 | 6/2012 | Freeman et al. | |

(Continued)

FOREIGN PATENT DOCUMENTS

DE 297 02 300 U1 11/1997

OTHER PUBLICATIONS

International Search Report and Written Opinion for PCT/US2014/029390 mailed Aug. 4, 2014.

*Primary Examiner* — Donnell Long
(74) *Attorney, Agent, or Firm* — Merchant & Gould P.C.

(57) ABSTRACT

A container for insertion of a carton containing a beverage ingredient into a beverage dispenser is disclosed. The container may include a base surface and a front surface, a back surface, and two side surfaces that may extend from the base surface. The surfaces may define a cavity sized to receive the carton. A method for inserting the carton containing the beverage ingredient into the beverage dispenser is disclosed. The method includes inserting the carton into the container, partially inserting the container into the beverage dispenser, and causing a fitment to engage the beverage dispenser. The fitment protruding from the carton.

19 Claims, 7 Drawing Sheets

(56) References Cited

U.S. PATENT DOCUMENTS

2003/0116584 A1* 6/2003 Gutierrez ..... B67D 1/0004 222/1
2003/0141317 A1 7/2003 Vance
2006/0071021 A1 4/2006 Steeves et al.
2006/0138168 A1* 6/2006 Last ..... B65D 35/28 222/105
2008/0041882 A1* 2/2008 Lips ..... B65D 77/067 222/183
2008/0121766 A1* 5/2008 Jorgensen ..... B67D 3/0083 248/150
2008/0277417 A1* 11/2008 Groesbeck ..... B65D 5/4204 222/105
2008/0283550 A1* 11/2008 Nighy ..... F04B 43/0736 222/1
2009/0283541 A1* 11/2009 Compton ..... B65D 77/068 222/105
2010/0147884 A1 6/2010 Compton et al.
2014/0263454 A1 9/2014 Connerat et al.

* cited by examiner

BEVERAGE DISPENSER CONTAINER AND CARTON

BACKGROUND

Beverage dispensers require ingredients to be added in order to form the beverage. Ingredients such as still water can be delivered directly from a plumbing system. Ingredients that give a beverage its taste, color, etc., may be installed using cartridges that contain the ingredients. These cartridges are expensive to manufacture and have to be discarded or recycled after they are depleted.

BRIEF DESCRIPTION OF THE DRAWINGS

The accompanying drawings, which are incorporated in and constitute a part of this disclosure, illustrate various embodiments of the present invention. In the drawings.

DESCRIPTION

Figure 1:
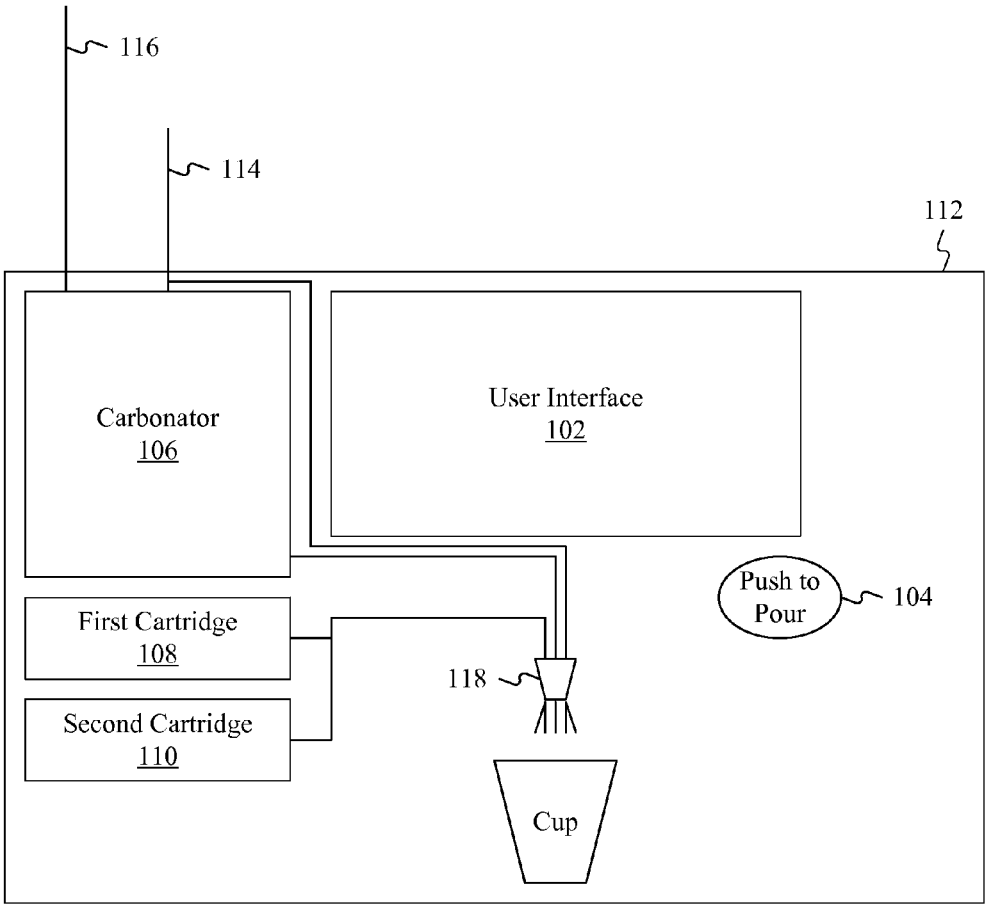
FIG. 1 shows a schematic of a beverage dispenser.

The following detailed description refers to the accompanying drawings. Wherever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the invention.

Embodiments include a container for insertion of a carton containing a beverage ingredient into a beverage dispenser. The container includes a base surface and a front surface, a back surface, and two side surfaces that extend from the base surface. The surfaces define a cavity sized to receive the carton.

Embodiments include a system for installing a beverage ingredient into a beverage dispenser. A carton contains the beverage ingredient. The carton includes a fitment extending from a carton surface. The fitment is sized to allow fluid communication between the carton and the beverage dispenser. A container includes a front surface, a back surface, and two side surfaces extending from a base surface. The front surface, the back surface, and the two side surfaces define a cavity sized to receive the carton. The front surface defines a landing sized to securely receive the fitment.

Embodiments include a method for inserting the carton containing the beverage ingredient into the beverage dispenser. The method includes inserting the carton into the container, partially inserting the container into the beverage dispenser, and causing a fitment to engage the beverage dispenser. The fitment protruding from the carton.

Embodiments include a method for manufacturing a carton and container for housing a beverage ingredient. The method includes injection molding the container to define a cavity for receiving the carton, and fabricating the carton having a fitment protruding from a carton surface. The fitment is for establishing fluid communication with a beverage dispenser.

Now turning to the figures, FIG. 1 shows a simplified schematic of a beverage dispenser 100. The beverage dispenser 100 includes a user interface 102, a pour input 104, a carbonator 106, and a plurality of ingredient cartridges (e.g., a first cartridge 108 a second cartridge 110) all enclosed in a housing 112. It should be understood that the user interface 102 may comprise any number of interfaces including, but not limited, a touchscreen, product selection buttons, one or more pour buttons and/or other user input devices. The buttons may include mechanical components or linkages, or may be electronic buttons such as a capacitive touch button. Furthermore, one or more of the buttons may be substituted by a lever or other mechanical or electronic actuation device It should be further, that in accordance with alternative embodiments, some or all of the aforementioned ingredient cartridges may be installed remotely from the housing 112 and pumped or otherwise supplied to the beverage dispenser 100. In accordance with various embodiments, the pour selector 104 may comprise a button or other inputs on the user interface 102 or alternatively, an input distinct from the user interface 102 such as a mechanical button or lever, an electrical touch sensitive surface such as a capacitive touch button or other distinct user input device for initiating the pouring of a beverage. It should be understood that the cartridges 108 and 110 may include any number of ingredients including, but not limited to, sweetened beverage bases or beverage syrups, sweetened flavors or flavor syrups, unsweetened beverage bases, unsweetened beverage base components (such as the acid, acid-degradable, and non-acid portions of a beverage base), unsweetened flavors, natural and artificial flavors, flavor additives, natural and artificial colors, nutritive or non-nutritive natural or artificial sweeteners, additives for controlling tartness (e.g., citric acid, potassium citrate, etc.), functional additives such as vitamins, minerals, or herbal extracts, nutraceuticals, medicaments, or alternative diluents such as juice, milk, or yoghurt. The ingredients may be concentrated with traditional beverage ingredients having reconstitution ratios of about 3:1 to about 6:1 or higher. The beverage micro-ingredients may have reconstitution ratios from about 10:1, 20:1, 30:1, or higher with many having reconstitution ratios of 50:1 to 300:1. The viscosities of the ingredients may range from about 1 to about 100 centipoise. While FIG. 1 shows the beverage dispenser 100 having two cartridges, the beverage dispenser 100 include any number of cartridges. The beverage dispenser 100 includes a still water input 114 and a $CO_2$ input 116. The still water input 114 and the $CO_2$ input 116 supply still water and $CO_2$ to the carbonator 106. The still water input 114 may also be supplied to a nozzle 118 for use in pouring still beverage from the beverage dispenser 100. One of ordinary skill in the art will recognize that the beverage dispenser may include one or more pumps, valves, flow control devices, or other devices (not shown) to control the flow of fluids through the beverage dispenser.

During operation, the beverage dispenser 100 receives a user selection of a beverage from the user interface 102. After the beverage is selected, the beverage dispenser 100 dispenses the beverage in response to the user pressing the pour input 104. During dispensing, carbonated water from the carbonator 106, still water from the still water input 114, or other diluents flow to the nozzle 118. At the same time, one or more beverage ingredients for the beverage flow from one or more of the plurality of cartridges to the nozzle 118. The nozzle 118 facilitates the dispensing and mixing of the various ingredients and diluents for producing a finished beverage. For example, the carbonated water may flow from the carbonator 106, a beverage base may flow from the first cartridge 108, and sweetener may flow from the second cartridge 110. The various ingredients may flow to the nozzle 118 where they are combined to from a "post-mix" finished beverage. In some embodiments, one or more of the ingredients remain separate until the exit the nozzle 118 and air mix within the fluid stream flowing out of the nozzle 118.

Figure 2:
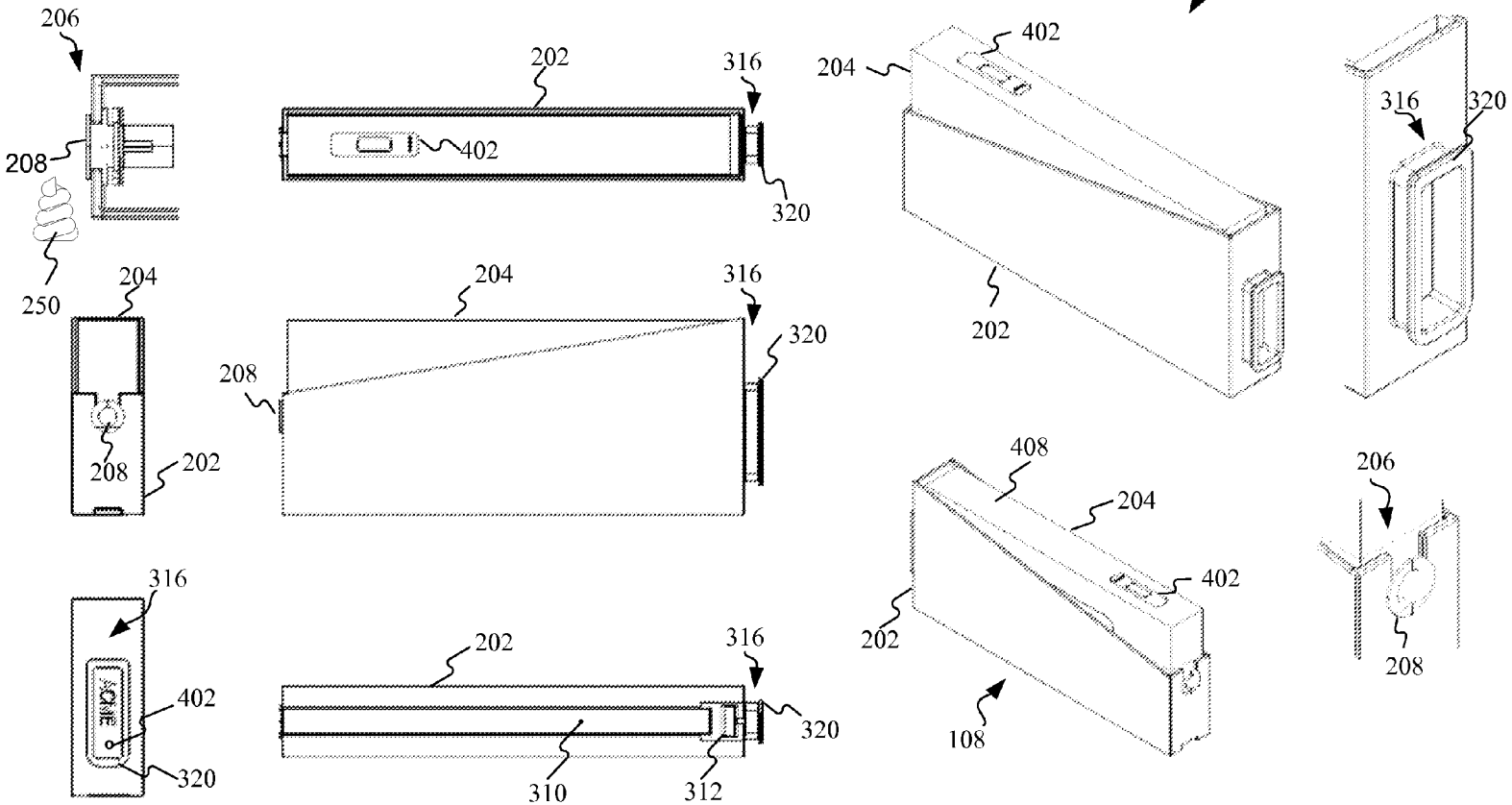
FIG. 2 shows a multi-view of a cartridge.

FIG. 2 shows a multi-view of one of the plurality of cartridges (e.g., a first cartridge 108). First cartridge 108 may include a container 202 (described in greater detail below with references to FIG. 3) and a carton 204 (described in greater detail below with references to FIGS. 4 and 5). The carton 204 contains a bag, pouch, bladder, or other flexible ingredient container (not shown) which stores beverage ingredients. In some embodiments, the ingredient container may be a rigid or semi-rigid container. In some embodiments, the ingredient container may be prone to breakage or otherwise difficult or expensive to handle or ship outside of the structure and protection provided by the carton 204. The ingredient container includes a fitment 208 for providing access to the beverage ingredients stored therein. In some embodiments, the carton may be a laminated container for directly storing the beverage ingredients without the use of an additional ingredient container. For example, the carton may be a carton described in U.S. Pat. No. 8,201,712 to Freeman et. al., incorporated herein by reference in its entirety for all purposes.

In some embodiments, the carton 204 may be made, at least in part, of paperboard, cardboard, honeycomb board, or other inexpensive and relatively available materials. Other materials or laminates may be used to construct the carton 204. As shown in FIG. 2 the carton 204 fits within the container 202. When the carton 204 is inserted within the container 202, a landing 206 receives the fitment 208. In some embodiments, the landing 206 may include a spring element or tab on either side of the landing 206 for securely holding the fitment 208 in the landing 206. In some embodiments, the spring element may apply a positive downward force on the fitment 208 or otherwise lock the fitment 208 in place so as to ensure proper seating and alignment of the fitment within the container 202. Moreover, the fitment 208 may include a lip or flange that engages with a front surface of the container 202 about the landing 206 so as to prevent the fitment 208 from passing through the landing 206. The fitment 208 connects with plumbing inside the beverage dispenser 100 via a probe (not shown) to establish fluid communication between the beverage ingredients stored in the carton 204 and the nozzle 118. Generally, the probe may be inserted into the fitment 208 and engage with and open a plug (not shown) of the fitment 208, thereby establishing a fluid pathway for the beverage ingredients through the probe and on to the nozzle 118. Upon retracting the probe from the fitment 208, the plug of the fitment 208 may be closed to prevent spilling of the beverage ingredients through the fitment 208. In some embodiments, the probe and the fitment 208 may take the form of those described in U.S. Pat. No. 6,871,679 to Last, incorporated herein by reference in its entirety for all purposes. As shown in FIG. 2, the container 202 includes a base surface, a front surface, a back surface and two side surfaces. As described in more detail below with reference to FIG. 5, the container 202 may be a single piece of injection molded plastic. In some embodiments, the container 202 may be made of other materials, such as metals, ceramics, wood, or any other materials or combinations thereof. Moreover, the container 202 may be constructed using any manufacturing process.

The container 202 may be used to insert the carton 204 into the beverage dispenser 100. A certain amount of force, $F_f$, may be applied to the fitment upon insertion of the probe to properly install the probe and open the plug so as to facilitate fluid communication of the beverage ingredients to the nozzle 118. However, in some embodiments, the carton 204 or ingredient container contained alone, or in combination, may not be sufficiently rigid or otherwise structurally strong enough so as to support the fitment 208 upon the application of force $F_f$ upon insertion of the probe. In other words, the carton 204 and/or ingredient container may bend, flex, or otherwise give way upon the application of for $F_f$, thereby preventing proper installation of the probe into the fitment 208. However, upon installing the carton 204 into the container 202 and seating the fitment 208 in the landing 206, the container 202 provides sufficient structural support to the fitment to enable proper installation of the probe in the fitment 208. In other words, the container 202 supports the fitment 208 in the landing 206 even upon application of the force $F_f$ to the fitment 208, thereby enabling proper installation of the probe in the fitment 208. Therefore, inexpensive materials may be used to store beverage ingredients in the carton 204 during delivering and handling of the beverage ingredients, while more expensive materials may be used to construct the reusable container 202 so as to provide sufficient structural support to the container 204 to enable installation in the beverage dispenser 100.

Figure 3:
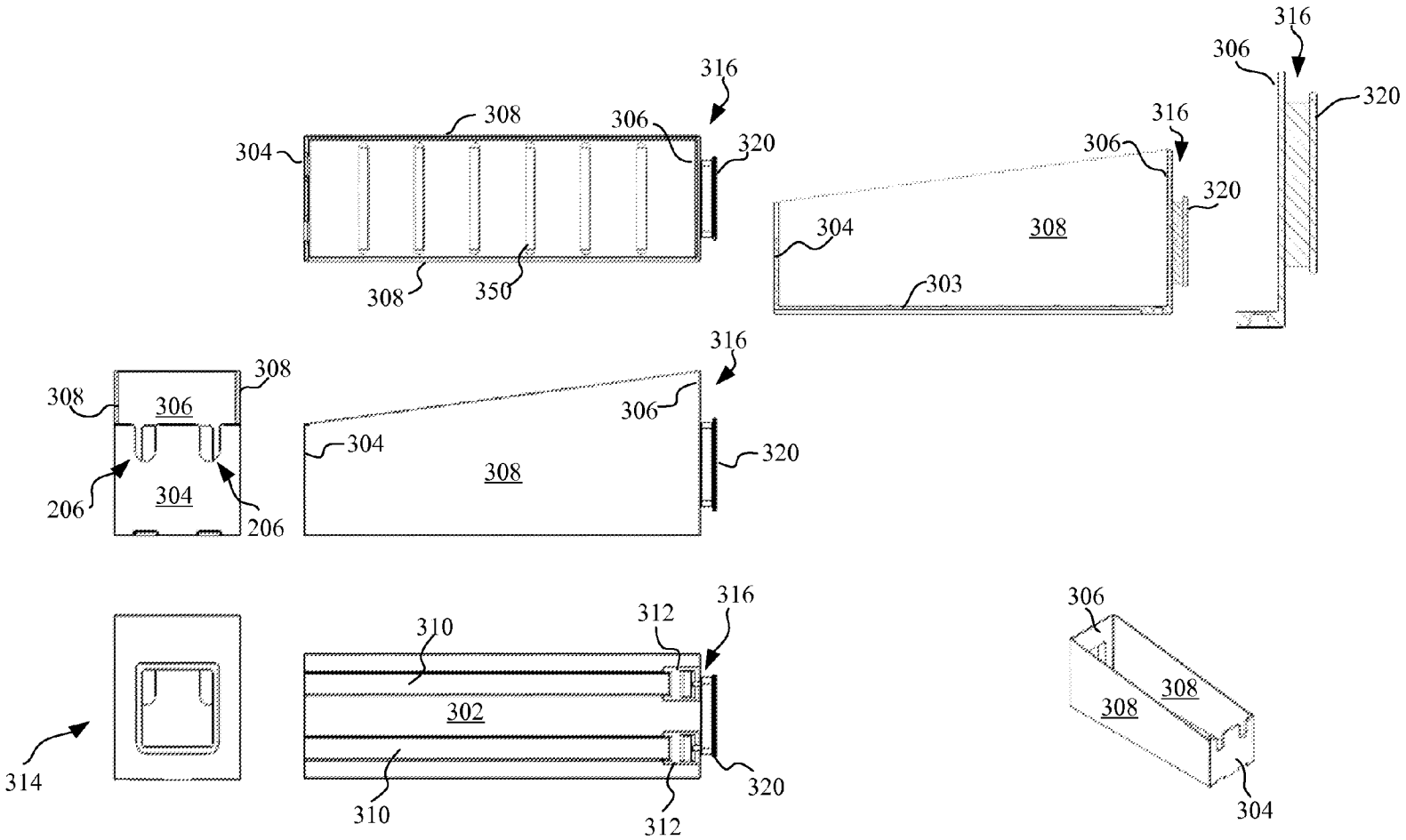
FIG. 3 shows a multi-view of a container.

FIG. 3 shows the container 302. The container 302 shown in FIG. 3 may accept two of the cartons 204. Thus, each of the cartons 204 in the container 302 may have two pouches. Alternatively, instead of two of the cartons 204, the container 302 may accept a single carton that has the capacity double that of the carton 204 (and thus may also store two pouches). The container 302 includes a base surface 303, a front surface 304, a back surface 306, and two side surfaces 308. The front surface 304, back surface 306, and two side surfaces 308 extend from the base surface 303 and may define a cavity sized to receive two of the carton 204. It should be appreciated that the base surface 303 may further include one or more "speed bumps" 350. In accordance with an embodiment, the speed bumps 350 may help provide a vacuum break and keep the carton 204 from setting in liquid if there are a few drips.

The base surface 303 may define an alignment groove 310. The alignment groove 310 extends from the front surface 304 to the back surface 306. While FIG. 3 shows the alignment groove 310 extending almost completely from the front surface 304 to the back surface 306, the alignment groove 310 may extend any length of the base surface 303. In addition, the alignment groove 310 may begin at any location along the base surface 303 and extend for any length of the base surface 303. For example, the alignment groove 310 may begin at a midpoint location long the base surface 303 and extend a quarter length of the base surface 303. In addition, multiple alignment grooves may be defined by the base surface 303.

The base surface 303 may also define a recess 312. The recess 312 may be sized to receive an insertion peg (not shown) connected to the beverage dispenser 100. For example, during installation, the insertion peg is connected to a lever connected to the beverage dispenser 100. A user may use the lever to apply an insertion force that is transferred to the insertion peg. The transferred force assists in seating the fitment 208 to the plumbing connecting it to the nozzle 118.

The container includes the landing 206. The landing 206 is defined by the front surface 304. The landing 206 is sized to receive the fitment 208. The landing 206 includes a flexible tab that acts to securely attach the carton 204 to the container 202.

The back surface 306 defines an opening 314. The opening 314 is sized to allow a product label 402 located on the carton 204 to be visible when the carton 204 is located within the container 202. The back surface 306 includes a protrusion 316. The protrusion 316 extends from the back surface 306. In addition, the protrusion 316 surrounds the opening 314 without substantially obscuring visibility of the product label 402.

The protrusion 316 is sized to allow the user to grip the protrusion 316. By allowing the user to grip the protrusion 316, the user is able to get a better grip on the container 202. For example, if multiple containers are installed side by side, it may be difficult to grip the two side surfaces 308. By gripping the protrusion 316, the user is able to exert a force great enough on the container 202 to facilitate extracting the container 202 from the beverage dispenser 100. The protrusion 316 may include a flared surface 320. The flared surface 320 facilitates the user to gripping the protrusion 316.

The carton 204 contains the beverage ingredient. The fitment 208 extends from a carton surface (e.g., any exterior surface of the carton 204). The fitment 208 is sized to allow fluid communication between the carton 204 and the beverage dispenser 100.

The carton 204 includes a tear away section 404. The tear away section 404 covers and protects the fitment 208 during delivery and handling of the beverage ingredients. When the tear away section 404 is torn away from the carton 204, the fitment 208 is exposed. The tear away section 404 may be a portion of the carton 204 that is perforated. The perforation allows the tear away section 404 to be torn from the carton 204. Alternatively, the tear away section 404 may be attached to the carton 204 with an adhesive. It should be understood that while the carton and containers (discussed above) are generally shown with a vertical orientation, they may also be modified to have a horizontal orientation without departing from the spirit or scope of the various embodiments described herein.

Figure 4:
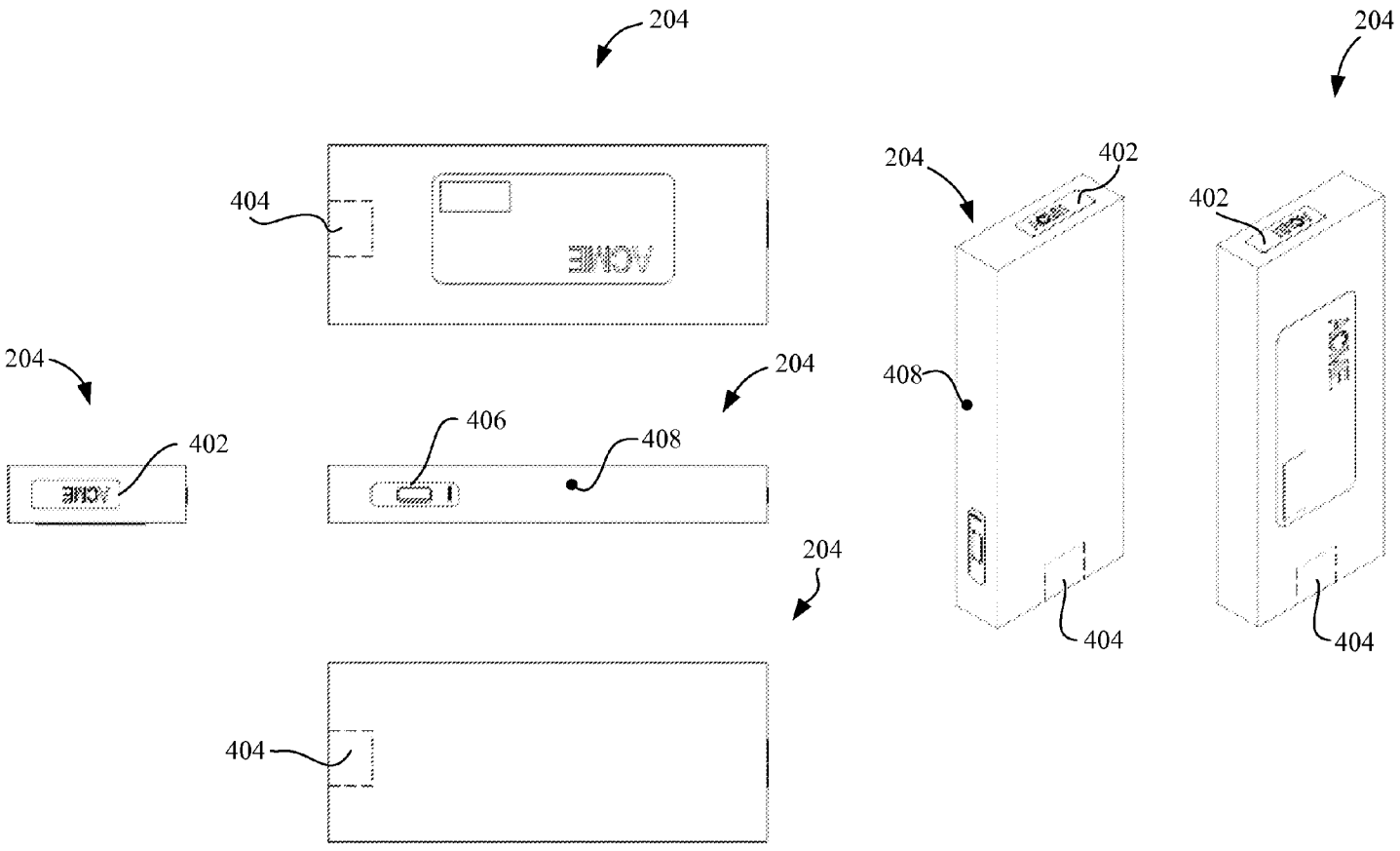
FIG. 4 shows a multi-view of a carton.

The carton 204 may include a radio frequency identification (RFID) chip 406. The RFID chip 406 may be attached to an interior or exterior surface of the carton 204. For example, as shown in FIG. 4, the RFID chip 406 may be attached to an exterior surface 408. In addition, the RFID chip 406 may be attached to an interior surface 602 (see FIG. 6). Furthermore, the RFID chip 406 may be embedded within a surface of the carton 204. For example, the exterior surface 408 may include a recess that may allow the RFID chip 406 to be flush with the exterior surface 408. Moreover, the RFID chip 406 may be embedded within the exterior surface 408 and covered. The covering may be made of the same material the carton 204 or made of a different material. The covering protects the RFID chip 406.

The RFID chip 406 may be used to identify the beverage ingredient to the beverage dispenser 100. For example, the RFID chip 406 may be encoded to communicate that the carton 204 is a starter pack. A starter pack may be a carton that is smaller than a standard beverage ingredient pack. For example, if a user purchases the beverage dispenser 100 for home use, the starter pack may contain a small sample of the beverage ingredient for the user to get started using the machine. In addition, the RFID chip 406 may communicate that the carton 204 is a sample pack. Sample packs may be offered to consumers at a lower cost and provide a small sample of the beverage ingredient. Manufacturers may offer sample packs so users can test new flavors and beverages. The sample packs and starter packs may have a carton that is a full size, but may have a bladder located within the carton 204 that is smaller than a bladder that may be located in a standard container. In addition, the carton 204 may contain multiple bladders. For example, the carton 204 may contain two bladders, each with the same or differing ingredients. Each bladder has a fitment 208 that engages the landing 206 shown in FIG. 3.

Figure 5:
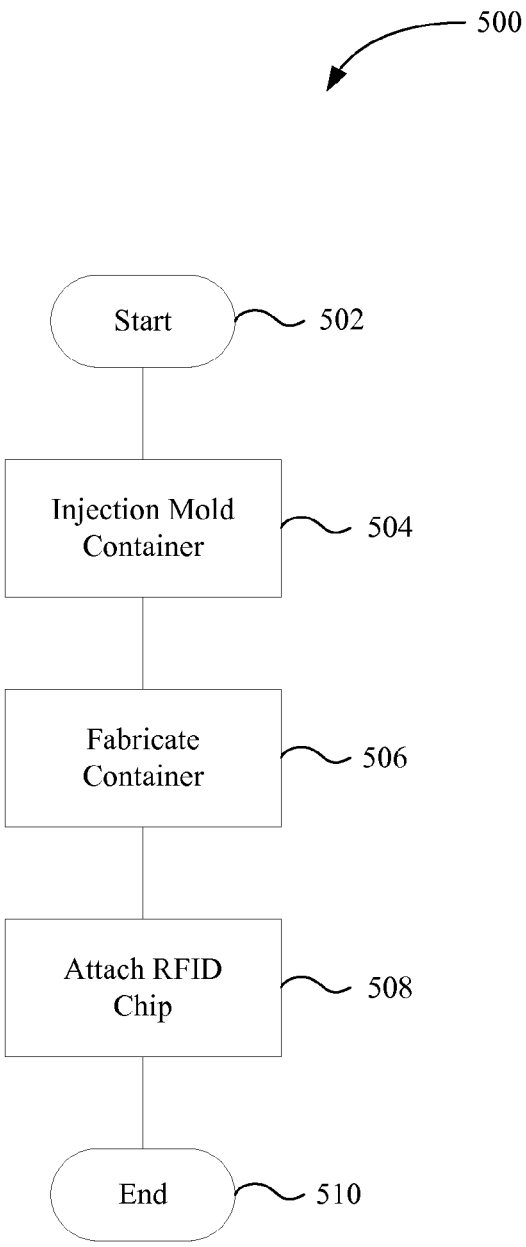
FIG. 5 shows a flow chart for a method for manufacturing a carton and a container for housing a beverage ingredient.

FIG. 5 shows a flow chart for a method 500 for manufacturing the carton 204 and the container 202. The method 500 begins at starting block 502 and progress to stage 504 where the container 202 is injection molded. For example, during stage 504 the container 202 is injection molded to define a cavity for receiving the carton 204. Furthermore, during the injection molding process or in a separate injection molding process, the fitment 208 may be formed. In addition, the landing 206 may be cut into the container 202 after the injection molding process. The opening 314 may be formed during the injection molding process or cut into the container 202 afterwards.

Other features of the container 202 may be formed during the injection molding process. For example, during the injection molding process the protrusion 316 that extends the back surface 306 may be formed. The protrusion 316 may also be attached to the back surface 306 after the back surface 306 is formed. For instance, the protrusion 316 may be attached to the back surface 306 with an adhesive or ultrasonic welding. The alignment groove 310 may be formed during the injection molding process or cut into the base surface 303. For example, a router may be used to cut the alignment groove 310 into the base surface 303.

From stage 504 where the container 202 is injection molded, the method 500 proceeds to stage 506 where the carton 204 is fabricated. Fabricating the carton 204 include fabricating the carton 204 to include the fitment 206 protruding from surface of the carton 204.

Figure 6:
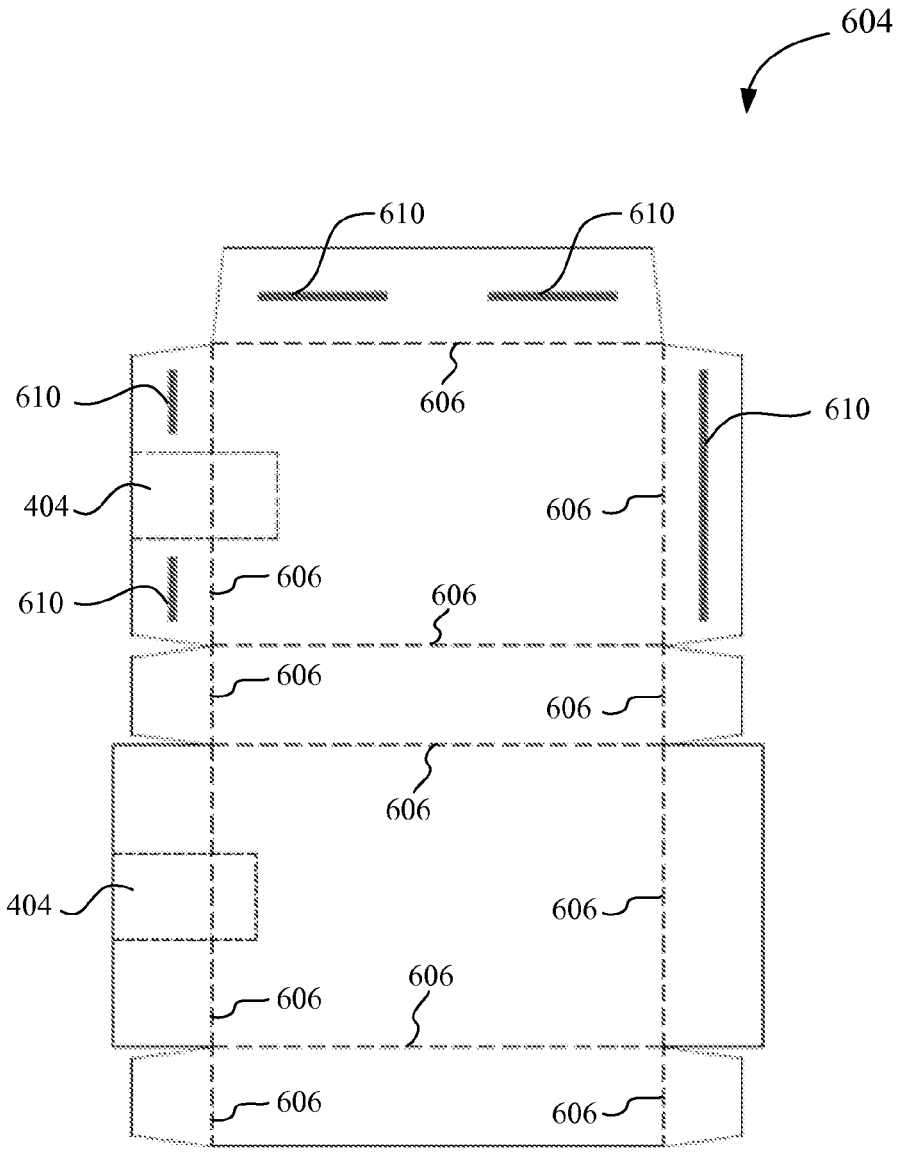
FIG. 6 shows an outline of a carton cut from a flat stock.

During stage 506 an outline 604 of the carton 204 is stamped from a flat stock. For example, FIG. 6 shows the outline 604 of carton 204 cut from a flat stock. Once the outline 604 has been cut, fold lines 606 are scored on a surface 608 of the flat stock. In addition, adhesive striping 610 is applied. The adhesive striping 610 is used to after folding the flat stock along the fold lines 606 to form an enclosure. The bladder is installed before the adhesive striping 610 is used to form the enclosure.

In addition, during stage 506, the tear away section 404 may be formed. For example, perforations may be cut into the flat stock during the stamping process. In addition, the tear away section 404 may be attached to the carton 204 during stage 506.

From stage 506 where the carton is formed, the method 500 may proceed to stage 508 where the RFID chip 406 is applied to the carton 204. For example, during stage 508, the RFID chip 406 may be applied to the interior surface 602 of the carton 204 as shown in FIG. 6. Furthermore, the RFID chip 406 may be embedded within a surface of the carton 204 as shown in FIG. 4. In some embodiments, the RFID chip 406 may be installed on an exterior surface of the carton 204, for example by application of a sticker or other such substrate containing the RFID chip 406. From stage 508 where the RFID chip 406 is installed, the method 500 terminates at termination block 510.

Figure 7:
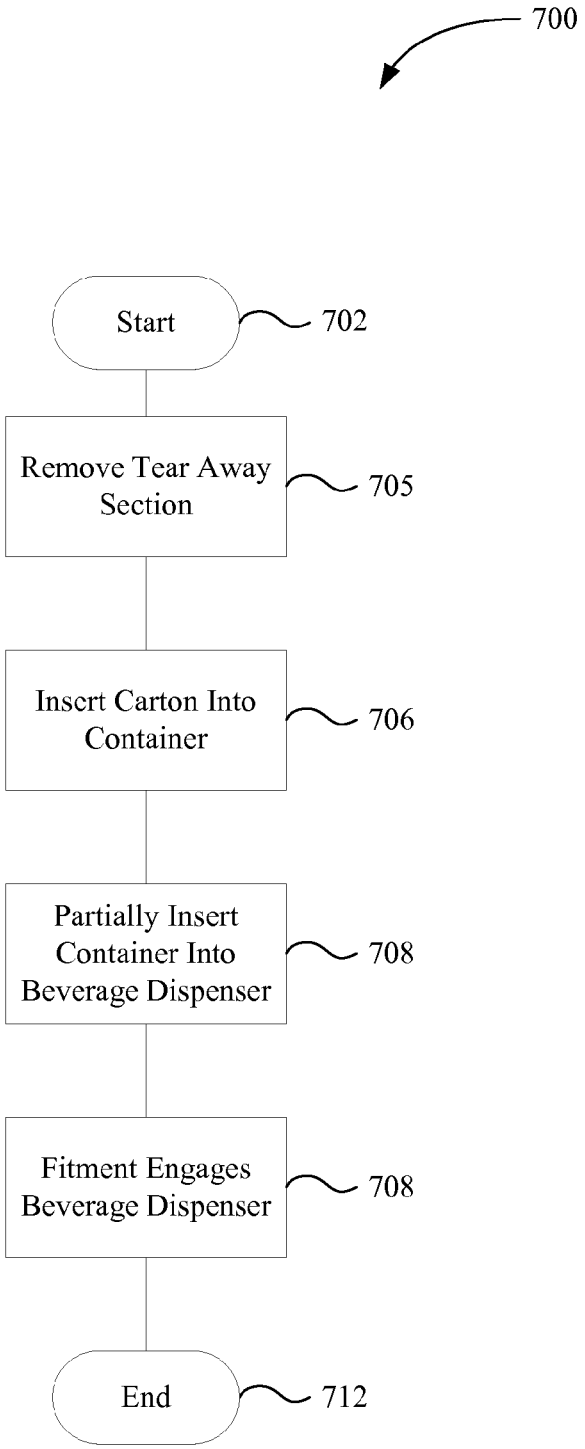
FIG. 7 shows a flow chart for a method for inserting a carton containing a beverage ingredient into a beverage dispenser.

FIG. 7 shows a flow chart for a method 700 for inserting the carton 204 containing a beverage ingredient into the beverage dispenser 100. The method 700 begins at starting block 702 and proceeds to stage 704 where the tear away section 404 is removed from the carton 204. From stage 704 where the tear away section 404 is removed, the method 700 proceeds to stage 706 where the carton 204 is inserted into the container 202. For example, the carton 204 is inserted into the cavity formed by the front surface 304, the back surface 306, and the two side surfaces 308. During insertion of the carton 204 into the container 202, the fitment 208 is inserted into the landing 206 defined by the front surface 304.

From stage 706 where the carton 204 is inserted into the container 202, the method 700 proceeds to stage 708 where the container 202 is partially inserted into the beverage dispenser 100. For example, during stage 708 the alignment groove 310 may be used to align the container 202. The alignment may assist in guiding the fitment 208 into the proper location to engage the plumbing of the beverage dispenser 100.

From stage 708 where the container 202 is partially inserted into the beverage dispenser 100, the method 700 proceeds to stage 710 where the fitment 208 is caused to engage the beverage dispenser 100. For example, during insertion of the carton 204 into the beverage dispenser 100 pressure is applied to the protrusion 316. The pressure may be applied by the user as he or she presses against the protrusion 316. In addition, the pressure may be applied by a door of the beverage dispenser 100 as the container 202 is being secured within the beverage dispenser 100. Furthermore, a lever attached to the beverage dispenser 100 may engage the recess 312 and may apply pressure to the container 202. The pressure causes the fitment to engage the plumbing of the beverage dispenser 100. From stage 710 the method 700 terminates at termination block 712.

Both the foregoing general description and the following detailed description are examples and explanatory only, and should not be considered to restrict the invention's scope, as described and claimed. Further, features and/or variations may be provided in addition to those set forth herein. For example, embodiments may be directed to various feature combinations and sub-combinations described herein.

While certain embodiments of the invention have been described, other embodiments may exist. While the specification includes examples, the invention's scope is indicated by the following claims. Furthermore, while the specification has been described in language specific to structural features and/or methodological acts, the claims are not limited to the features or acts described above. Rather, the specific features and acts described above are disclosed as examples for embodiments of the invention.

What is claimed is:

1. A container for insertion of a carton containing a beverage ingredient into a beverage dispenser, the container comprising:

a base surface; and a front surface, a back surface, and two side surfaces extending from the base surface and defining a cavity sized to receive the carton;

wherein the base surface defines an alignment groove extending at least partially from the front surface to the back surface.

2. The container of claim 1, wherein the front surface defines a landing sized to receive a fitment attached to the carton.

3. A container for insertion of a carton containing a beverage ingredient into a beverage dispenser, the container comprising:

a base surface;

a front surface, a back surface, and two side surfaces extending from the base surface and defining a cavity sized to receive the carton; and a protrusion extending from the back surface, the protrusion sized to allow a user to grip the protrusion for extracting the container from the beverage dispenser.

4. The container of claim 3, wherein the back surface defines an opening sized to allow a product label located on the carton to be visible when the carton is located within the container, and wherein the protrusion surrounds the opening without substantially obscuring visibility of the product label.

5. The container of claim 3, wherein the protrusion comprises a flared surface sized to facilitate the user to grip the protrusion.

6. A system for installing a beverage ingredient into a beverage dispenser, the system comprising:

a carton containing the beverage ingredient, the carton comprising a fitment extending from a carton surface, the fitment sized to allow fluid communication between the carton and the beverage dispenser; and a container comprising a front surface, a back surface, and two side surfaces extending from a base surface, the front surface, the back surface, and the two side surfaces defining a cavity sized to receive the carton, the front surface defining a landing sized to securely receive the fitment;

wherein the front surface further comprises a flexible tab for securing the fitment within the landing.

7. The system of claim 6, wherein the carton is a starter pack.

8. The system of claim 6, wherein the carton comprises a radio frequency identification chip attached to an interior surface of the carton.

9. The system of claim 6, wherein the carton comprises a radio frequency identification chip embedded within an exposed surface of the carton.

10. The system of claim 6, further comprising a bladder located within the carton, the bladder housing the beverage ingredient.

11. The system of claim 6, further comprising the beverage dispenser including a nozzle, the fitment in fluid communication with the nozzle.

12. A system for installing a beverage ingredient into a beverage dispenser, the system comprising:

a carton containing the beverage ingredient, the carton comprising a fitment extending from a carton surface, the fitment sized to allow fluid communication between the carton and the beverage dispenser; and a container comprising a front surface, a back surface, and two side surfaces extending from a base surface, the front surface, the back surface, and the two side surfaces defining a cavity sized to receive the carton, the front surface defining a landing sized to securely receive the fitment;

wherein the container further comprises a protrusion extending from the back surface, the protrusion sized to allow a user to grip the protrusion for extracting the container from the beverage dispenser.

13. The system of claim 12, wherein the back surface defines an opening sized to allow a product label located on the carton to be visible when the carton is located within the container, and wherein the protrusion surrounds the opening without substantially obscuring visibility of the product label.

14. The system of claim 12, wherein the protrusion comprises a flared surface sized to facilitate the user to grip the protrusion.

15. A container for insertion of a carton containing a beverage ingredient into a beverage dispenser, the container comprising:

a base surface; and a front surface, a back surface, and two side surfaces extending from the base surface and defining a cavity sized to receive the carton;

wherein the base surface defines a recess sized to receive an insertion peg connected to the beverage dispenser.

16. A container for insertion of a carton containing a beverage ingredient into a beverage dispenser, the container comprising:

a base surface; and a front surface, a back surface, and two side surfaces extending from the base surface and defining a cavity sized to receive the carton;

wherein the back surface defines an opening sized to allow a product label located on the carton to be visible when the carton is located within the container.

17. A system for installing a beverage ingredient into a beverage dispenser, the system comprising:

a carton containing the beverage ingredient, the carton comprising a fitment extending from a carton surface, the fitment sized to allow fluid communication between the carton and the beverage dispenser; and a container comprising a front surface, a back surface, and two side surfaces extending from a base surface, the front surface, the back surface, and the two side surfaces defining a cavity sized to receive the carton, the front surface defining a landing sized to securely receive the fitment;

wherein the base surface defines an alignment channel extending at least partially from the front surface to the back surface.

18. A system for installing a beverage ingredient into a beverage dispenser, the system comprising:

a carton containing the beverage ingredient, the carton comprising a fitment extending from a carton surface, the fitment sized to allow fluid communication between the carton and the beverage dispenser; and a container comprising a front surface, a back surface, and two side surfaces extending from a base surface, the front surface, the back surface, and the two side surfaces defining a cavity sized to receive the carton, the front surface defining a landing sized to securely receive the fitment;

wherein the back surface defines an opening sized to allow a product label located on the carton to be visible when the carton is located within the container.

19. A system for installing a beverage ingredient into a beverage dispenser, the system comprising:

a carton containing the beverage ingredient, the carton comprising a fitment extending from a carton surface, the fitment sized to allow fluid communication between the carton and the beverage dispenser; and a container comprising a front surface, a back surface, and two side surfaces extending from a base surface, the front surface, the back surface, and the two side surfaces defining a cavity sized to receive the carton, the front surface defining a landing sized to securely receive the fitment;

wherein the carton comprises a tear away section that when torn away from the carton exposes the fitment.

* * * * *